United States Patent [19]

Harris

[11] Patent Number: 4,918,829

[45] Date of Patent: Apr. 24, 1990

[54] FLUIDIZED BED FLIGHT APPARATUS

[75] Inventor: Gerald E. Harris, Haddonfield, N.J.

[73] Assignee: Campbell Soup Corporation, Camden, N.J.

[21] Appl. No.: 176,233

[22] Filed: Mar. 31, 1988

[51] Int. Cl.[5] ..... F26B 17/18

[52] U.S. Cl. ..... 34/10; 34/57 A; 34/57 B

[58] Field of Search ..... 34/10, 57 A, 57 R, 181, 34/179, 57 D

[56] References Cited

U.S. PATENT DOCUMENTS 1,213,962 1/1917 Siler ..... 34/57 C 4,608,766 9/1986 Kawai et al. ..... 34/57 A

*Primary Examiner*—Henry A. Bennet

*Attorney, Agent, or Firm*—Banner, Birch, McKie & Beckett

[57] ABSTRACT

Apparatus which prevents particles fluidized in an indexing fluidized bed from passing under a moving flight comprising a device which directs the flow of the fluidizing medium so that the particles are directed away from the gap between the stationary grid and the moving flight. The invention also relates to a method of preventing the particles from passing under a moving flight by imparting a horizontal velocity component to the fluidizing medium so that the particles are urged away from the gap.

16 Claims, 4 Drawing Sheets

FLUIDIZED BED FLIGHT APPARATUS

BACKGROUND OF THE INVENTION

1. Field of the Invention

This invention relates to a fluidized bed flight apparatus. More particularly, the invention relates to a flight apparatus for an indexing fluidized bed which prevents the fluidized particles from becoming trapped under or passing under the flight.

2. Description of the Prior Art

Conventional fluidized bed apparatus are well known in the art. Such apparatus typically have a variety of uses such as dryers, reactors, surface coating devices, and particle size classifiers. The design of the apparatus is dependent upon the use to which the apparatus is put.

Typically, a fluidizing medium is flowed upward through a bed of solid particles. A relationship known to those skilled in the art and based on the size, shape, and density of the particles is utilized to establish a range of flow rates for the fluidizing medium so that the particles become fluidized, i.e., they are buoyed in the fluidizing medium in a fashion which allows the mass of solid particles to behave as if it were a fluid. The mass of fluidized particles assumes the shape of the vessel in which it is confined. Although the particles may still touch each other while fluidized, they are buoyantly suspended in the fluidizing medium so that lateral friction forces are reduced. This buoyancy does not result soley from the difference between the density of the particles and the density of the fluidizing medium. Rather, it results from the upward force exerted by the upwardly flowing fluidizing medium.

Particle shape affects the magnitude of the buoyant force exerted on the particle. At a given fluidizing medium velocity, the force exerted on the particle is proportional to the area of the particle upon which the flow impinges. The weight of the particle also affects the ability of the fluidizing medium to lift the particle. Indeed, the velocity of the fluidizing medium can be adjusted so that particles are lifted by, fall through, or are held statically in the fluidizing medium. The quantity of particles in the fluidizing medium can also be adjusted.

Designs of fluid bed apparatus are as varied as are the uses to which the apparatus are put. Fluidizing medium is flowed upward, typically through a distributor. The distributor is designed to ensure even distribution of the fluidizing medium while preventing solid particles from escaping from the bed. If it is desired to separate the fluidizing medium from the solid particles before the medium flows out of the vessel, there must be a way to retain particles in the vessel. Therefore, either a disengaging space or a mechanism for separating solid particles from the fluidizing medium must be provided. Examples of such mechanisms include cyclones and grids. Divers devices for introducing and removing solid particles from the fluidized mass are also known in the art.

Although the confining vessel of many fluidized beds is a vertical cylinder, other designs are utilized. For example, an indexing fluidized bed apparatus often is used when the duration of the contact between the solid particles and the fluidizing medium must be strictly controlled. An indexing fluidized bed apparatus comprises a device which ensures that solid particles are moved through the fluidizing medium within a predetermined period. Typically, such a device limits the length of the contact between particles and fluidizing medium by moving a confining vessel and physically urging particles through the fluidizing medium.

A typical indexing apparatus comprises flights on at least one endless device, such as a belt or roller chain, which is horizontally-disposed within a compartment having a grid as its bottom or floor. A plurality of such endless, or continuous, devices would be essentially parallel, equidistant from the grid, and spaced across the width of the compartment. Flights, which are rigid or semi-rigid, typically planar, partitions disposed from the continuous device, extend between side walls of the compartment and are moved through the compartment by moving the continuous device, as illustrated in FIG. 1. The grid distributes the fluidizing medium while preventing escape of particles. Thus, a confining vessel is formed by the grid, leading and trailing adjacent flights, the side walls, and a top which retains particles, and is moved through the fluidizing medium by the motion of the flights. The linear velocity of the device and the spacing of flights are adjusted to ensure that particles are exposed to fluidizing medium only for a predetermined period. If desired, the grid may be subdivided into zones in the direction the device travels, so particles can be sequentially exposed to a plurality of fluidizing medium.

Various designs for attaching flights to the continuous device are known in the art. For example, the top of the flights may be attached to the device, with the flights extending from the device to the grid, as shown in FIG. 1. Alternatively, the continuous device may be disposed on the side of the flight, so that the flight extends both above and below the device. Other relationships between the flights and the continuous device are known to practitioners.

If the continuous device is at the top of the flight, it may serve to keep the particles in the fluidized bed while allowing fluidizing medium to flow around or through it. More typically, however, the side walls of the compartment are not parallel, but are spaced further apart at the top of the bed than they are at the grid, as illustrated in FIGS. 1*a* and 1*b*. Such a design serves to retain particles in the confining vessel. As those skilled in the art recognize, the vertical velocity of the fluidizing medium is not constant, but decreases as the side walls diverge, and the relationship between the fluidized particles and the fluidizing gas can be manipulated in accordance with well-known particles to ensure that particles remain fluidized without escaping over the flights.

Inevitably, there will be spaces between the flight and the walls and bottom of the compartment. Such spaces are required to allow for manufacturing tolerances, mechanical clearances, and the like. These gaps typically are minimized, with the flight being able to urge particles out of the fluidizing medium without deleteriously effecting the particle of damaging either the particle or the flight. It is clear that particles which will overreact, burn, break, or otherwise be damaged when overexposed to fluidizing medium must be urged out of the fluidizing medium in a timely fashion. Therefore, the acceptable gap is related to the size of the particles and the necessity of removing the particles from the fluidizing bed undamaged and before the particles are over-exposed to the fluidizing medium. Similarly, particles cannot be allowed to enter the gap if the particle (or indeed the flight itself) will be damaged if the particle is caught in the gap.

Because the confining vessel is moved through the fluidizing medium by moving the flights, particles typically are trapped only by the trailing flight. Various methods have been proposed for ensuring that fluidized particles cannot pass under the trailing flight or become trapped in the gap between the flight and the grid. One such proposal calls for the attachment of strips of flexible material such as rubber or Teflon® to the flight so that the flexible material contacts the grid. However, this technique is not satisfactory because particles because trapped between the flexible material and the stationary grid. The particles are therefore scraped along the grid as the flight moves, thereby damaging the grid, the flight, or the particles. Others have proposed that a more rigid yet flexible material such as thin stainless steel be attached to the flight to contact the stationary grid. However, either this material or the grid will be abraded by the contact. The abraded material will become fluidized and mix with the solid particles. Such added material is often unacceptable, for example, where the fluidized material is a food product or component thereof.

It is an object of this invention to provide apparatus for preventing particles fluidized in an indexing fluidized bed from passing under the trailing flight or becoming trapped between the flight and the bottom of the fluidizing compartment.

It is a further object of this invention to provide a flight for an indexing fluidizing bed apparatus which prevents fluidized particles from passing under the trailing flight or becoming trapped between the flight and the bottom of the fluidizing compartment.

It is another object of this invention to provide a flight for indexing fluidizing bed apparatus which directs the flow of fluidizing medium to prevent fluidizing particles from passing under the flight or becoming trapped between the flight and the grid.

It is yet another object of this invention to provide additional agitation in an indexing fluidized bed to ensure thorough mixing or aid in preventing agglomeration.

It is still further an object of this invention to provide a method for preventing fluidized particles from passing under a flight or becoming trapped between the flight and the grid in an indexing fluidized bed.

SUMMARY OF THE INVENTION

In accordance with these and other objects, this invention relates to apparatus which prevents particles fluidized in an indexing fluidized bed in which at least one vessel for confining fluidized particles is formed from passing under a moving flight. The apparatus comprises a horizontal chamber having first and second side walls, separate mechanisms for introducing and removing particles from the chamber, a bottom through which fluidizing medium is introducible and distributable, and a plurality of flights disposed from a device for moving the flights through the chamber, and a top which prevents fluidized particles from escaping over the flights. A confining vessel is formed by leading and trailing adjacent flights, the side walls, the bottom, and the top. Each flight extends between the side walls and from the top essentially to the bottom. Each trailing flight comprises means for imparting a horizontal velocity component to the fluidizing medium to prevent particles from escaping from the vessel between the trailing flight and the bottom as the trailing flight is moved through the chamber. The invention also relates to a method of preventing the particles from passing under a moving flight by imparting a horizontal velocity component to the fluidizing medium so that the particles are urged away from the gap.

BRIEF DESCRIPTION OF THE DRAWINGS

Throughout the figures, like numbers are utilized to identify like parts.

DETAILED DESCRIPTION OF THE INVENTION

The present invention is based on the discovery that flow of fluidizing medium in an indexing fluidized bed apparatus can be directed so as to prevent fluidized particles from passing under a moving flight. This invention obviates the need for a mechanical seal at the bottom of the flight and therefore eliminates problems associated with such seals.

Throughout the specification, the word "horizontally" includes angles of inclination at which indexing fluidized bed apparatus reasonably can be expected to operate properly. Those skilled in the art recognize that indexing fluidized bed apparatus can be operated at angles of inclination which are different from horizontal, and this invention includes such inclined operations.

Figure 1:
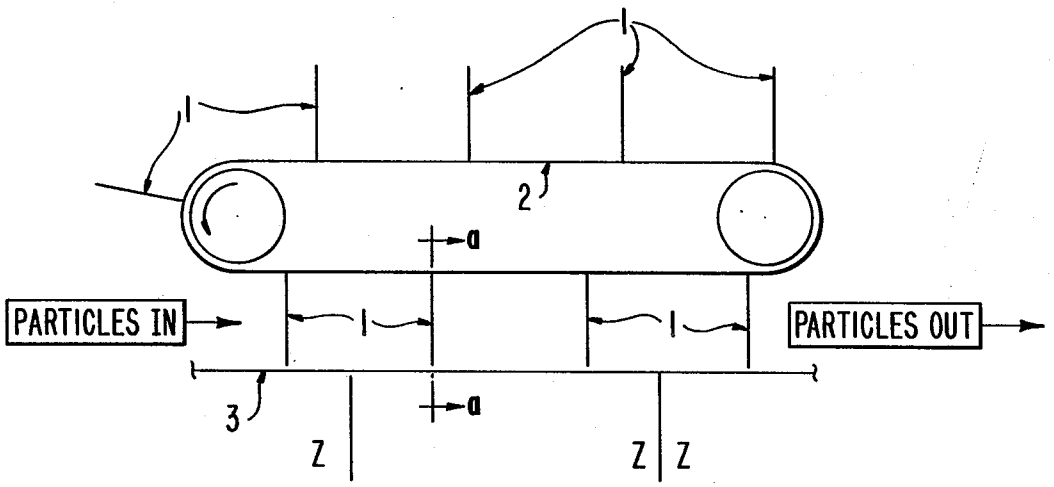
FIG. 1 (PRIOR ART)
FIG. 1 illustrates a prior art embodiment of an indexing fluidized bed flight apparatus.
Figure 1A:
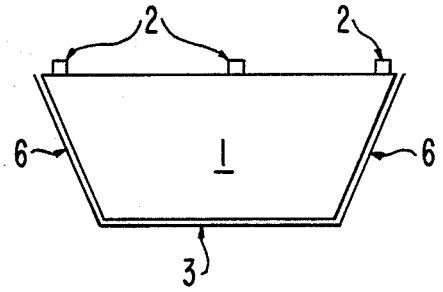
FIG. 1*a* illustrates the side view of the apparatus of FIG. 1.
Figure 1B:
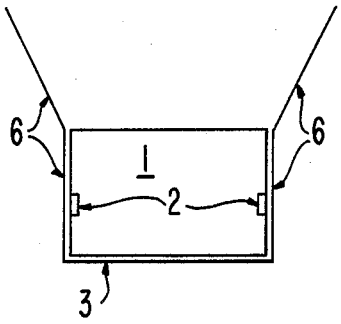
FIG. 1*b* illustrates a side view of an alternate embodiment of the apparatus of FIG. 1.

A typical prior art indexing fluidized bed apparatus is illustrated in FIGS. 1, 1*a*, and 1*b*. A plurality of flights 1 is attached to movable horizontally disposed continuous device 2. Fluidizing medium is introduced through stationary grid 3, which also forms the bottom of the confining vessel. Flights 1 form two sides of the confining vessel while the walls of the enclosure 6, shown in FIGS. 1*a* and 1*b*, typically form the other two sides. Device 2 may cooperate to form a top.

Details of construction of the fluidized bed apparatus form no part of this invention. For example, the walls of the enclosure will often form the walls of the confining vessel, but the confining walls can be formed from an interior wall or partition. Similarly, grid 3, which forms the bottom of the confining vessel and distributes fluidizing medium, can be a perforated plate, a series of closely spaced parallel bars, or any other configuration known in the art. Further, the grid may be divided into a plurality of zones Z by conventional dividers in the direction the flights move, as illustrated FIG. 1, so that particles can be exposed to a plurality of fluidizing media or media at different conditions, e.g., at different temperatures. Device 2 can be of any length and construction, and may be one or more devices, such as a belt, chain, or roller chain, essentially equidistant from the grid. If a plurality of devices is used, typically they are essentially parallel to each other and spaced across the width of the flight. There can be any distance between flights 1, which can be affixed to the horizontal device in any manner.

Further, because various particles are fluidized in various media to achieve diverse purposes, numerous materials of construction are appropriate for the practice of this invention. For example, extreme heat or corrosivity of the particles or the fluidizing medium may require exotic or unusual construction materials. Similarly, if edible food-stuffs are to be processed, the material of construction must be sterilizable. Device 2 may be made from flexible material or may be made from rigid material assembled so as to be sufficiently flexible to form a suitable continuous device. Finally, the material from which the flights are manufactured must be sufficiently rigid so as to urge fluidized particles out of the fluidized zone and to resist deformation by the stresses of the contact with fluidized particles and flow of fluidizing medium over the surface of the flight.

Particles are introduced into the fluidized bed apparatus in any suitable manner known in the art, are urged through the apparatus by the movement of the flights, and are removed from the apparatus in any suitable manner known in the art, as shown in FIG. 1. Fluidizing medium is introduced into a containing vessel through grid 3, and leaves the apparatus after being separated from the particles. The fluidizing medium may be collected and re-used. Fluidized particles are retained in a confining vessel comprising grid 3, two side walls 6, illustrated in FIGS. 1*a* and 1*b*, leading and trailing adjacent flights 1, and a mechanism for retaining particles in the vessel acting in cooperation with each other. Device 2 may serve as a top, but any particle-barrier, such as but not limited to, spaced bars or a screen, can be used. Alternatively, the apparatus can be designed so that the side walls are spaced further apart at the top than at the grid, as illustrated in FIGS. 1*a* and 1*b*, and may also have a particle barrier above the flight. Thus, above the top of the flight, the velocity of the fluidizing medium becomes insufficient to impart a vertical velocity to the fluidized particles, and the particles are prevented from flowing over the flight. The particles are subsequently removed from the apparatus and separately recovered.

Flights 1 typically are illustrated in the figures as comprising one piece. However, those skilled in the art will recognize that any construction method yielding a substantially rigid or semi-rigid flight which does not allow passage of fluidized particles and is not significantly deformed by the flow of fluidizing medium is acceptable. For example, flights 1 could consist of a plurality of smaller segments suitably attached or adhered to each other.

Fluidized particles, together with the confining vessel, are moved through the fluidized zone by the motion of device 2 and flights 1 attached thereto. Particles therefore contact both the leading flight and the trailing flight which form the containing vessel, and may become lodged between the moving flights and the grid or the side walls. Typically, particles become lodged in or pass through gaps between the trailing flight and the fixed structure.

It has been discovered that fluidized particles can be prevented from passing through or lodging in the gap between moving flight 1 and stationary grid 3 by directing a portion of the flow of the fluidizing medium so as to impart a horizontal velocity component which urges particles away from the gap. It has also been discovered that this flow is also useful in providing additional agitation within the fluidized mass. Such agitation is useful in ensuring thorough mixing and preventing particle agglomeration. The flow directing apparatus of the invention, which is attached to the flight and is spaced apart from the stationary grid, eliminates the need for the flight itself, or any extension thereof, to contact the grid. Such contact would cause wear of these parts and concomitant contamination of the fluidized particles.

Figure 2:
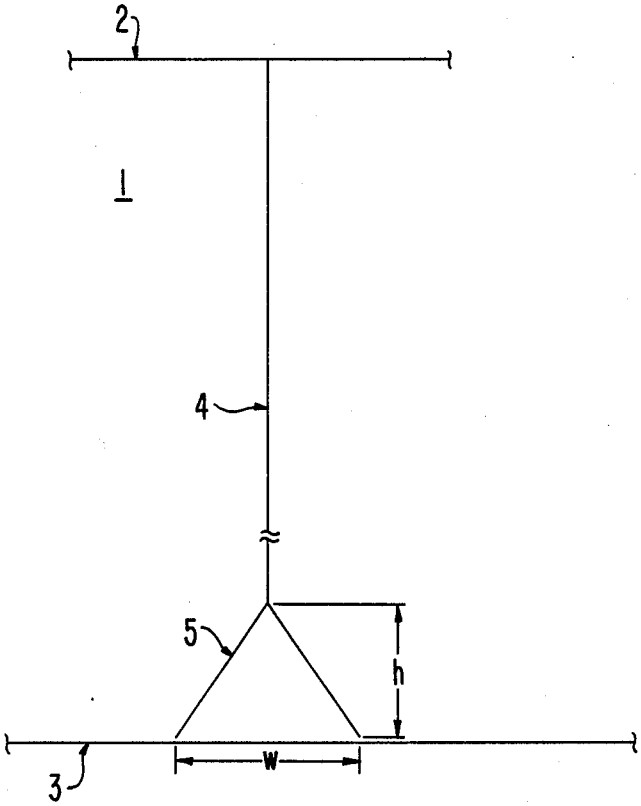
FIGS. 2, 2*a*, 2*b*, and 2*c* illustrate preferred embodiments of this invention.

FIG. 2 illustrates a preferred embodiment of this invention, and its relationship with device 2 and grid 3. Flight 1 comprises plate 4 and flow directing device 5. As described above and known in the art, plate 4 can extend above device 2. Plate 4 typically is essentially planar, although any form which suitably urges fluidized particles through the fluidizing medium may be utilized. Plate 4 is sufficiently rigid to urge particles through the fluidizing medium essentially without being deformed by the flowing fluidizing medium. Fluidizing medium impinges upon flow directing device 5 after flowing through grid 3. Flow directing device 5 imparts a horizontal velocity component to the fluidizing medium which urges particles away from the gap between the bottom of moving flight 1 and stationary grid 3 and agitates the fluidized mass.

The embodiment illustrated in FIG. 2, wherein the flow directing device comprises an open, essentially symmetrical, inverted "V" attached to the bottom of a flight, provides gentle agitation of the fluidized mass. It is, therefore, conveniently utilized in situations where violent agitation may damage the fluidized particles. For example, the embodiment illustrated in FIG. 2 is particularly suited for fluidizing foodstuffs such as noodles. The horizontal flow induced by the use of this embodiment is gentle enough to agitate the noodles without damaging them, yet is sufficient to prevent agglomeration.

Figure 2A:
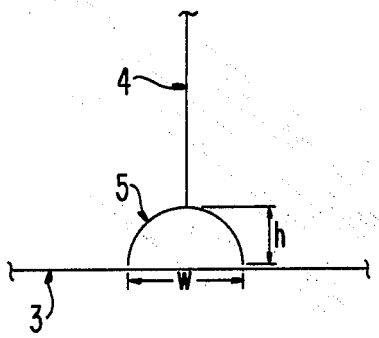
Figure 2B:
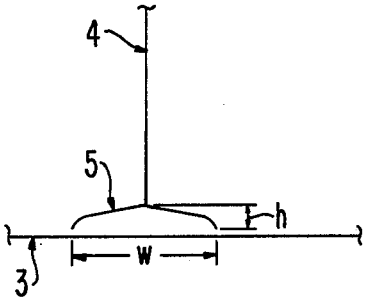
Figure 2C:
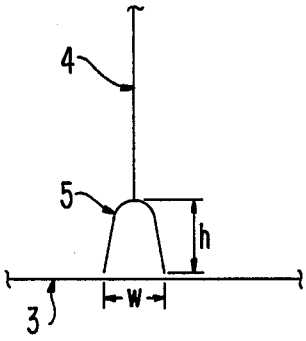

Other shapes can be used to cause horizontal flow of fluidizing medium. For example, semi-circular or semi-elliptical shapes, with the opening oriented toward the grid, as illustrated in FIGS. 2*a*, 2*b*, and 2*c*, are also suitable. The precise shape and ratio of height (h) to width (w) may be selected to cause the desired amount of horizontal flow.

The embodiment illustrated in FIG. 2 is not conveniently adjusted or changed to modify the degree of agitation provided thereby. The embodiment illustrated in FIG. 3, an enclosed triangular shape, can be manufactured with a preselected angle alpha if subparts 5*a*, 5*b*, and 5*c* are fixedly attached to the flight. However, in the alternative, subparts 5*a*, 5*b*, and 5*c* can be joined by hinges or the like so that angle alpha can be adjusted by moving subpart 5*a* parallel to plate 4 as illustrated in dashed line. Thus, moving subpart 5*a* away from subpart 5*c* increases angle alpha.

Figure 3:
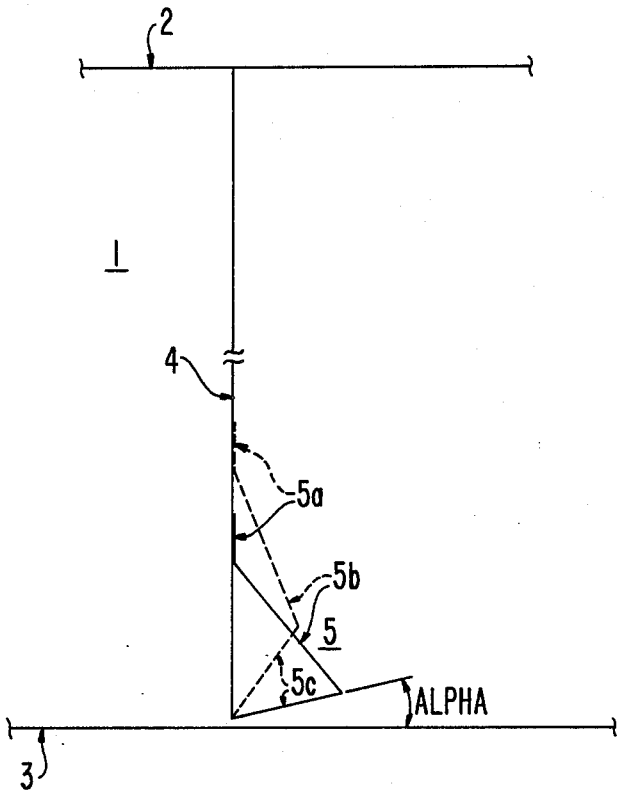
FIGS. 3 and 4 depict alternative embodiments of the flow directing device of the present invention.

Where, as in the embodiment illustrated in FIG. 3, flow directing device 5 may be adjusted, any device suitable for adjustably attaching flow directing device 5 to plate 4 may be utilized. For example, if plate 4 is capable of attracting a magnet, device 5*a* could be a magnet attached to subpart 5*b* by a hinge or other suitable device, as described above. Similarly, device 5*a* could be slotted to receive at least one locking device so that, when the device is unlocked, subpart 5*a* can be moved in the plane parallel to the plane of plate 4. The locking device then is locked when the flow directing device has been properly adjusted.

The embodiment illustrated in FIG. 3 can be made to provide a great deal of agitation to fluidized particles. As angle alpha is changed, the degree of agitation will change. Skilled practitioners are able to determine an angle alpha which provides the degree of agitation desired.

The embodiments illustrated in FIGS. 2 and 3 are especially suitable for use in situations requiring sanitary handling of product, as is required for foodstuffs. The flight apparatus exemplified in these figures do not tend to trap food particles.

Figure 4:
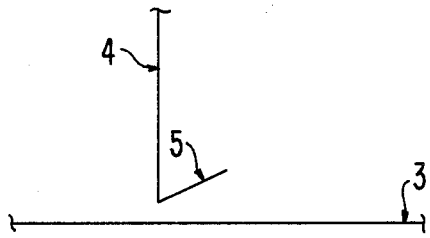

FIG. 4 illustrates an embodiment which is less satisfactory because of the likelihood that particles will come to rest on flow directing device 5. Collection of particles on flow directing device 5 is unacceptable in food processing applications and undesirable in almost every application. When the flight reaches the end of the horizontal run and is inverted, particles which had collected on flow directing device 5 will fall back to the grid or onto the continuous device. Not only is this wasteful, but also it causes particles to be distributed throughout the apparatus, causing maintenance and control problems.

Every embodiment of flow directing device 5 is disposed on the upstream side of plate 4, i.e., is, it is disposed on the side toward which the flight is moved. Turning to FIG. 1 as an example, flow directing device 5 would be disposed on the right side of plate 4 if device 2 moved in the counter-clockwise direction.

Flow directing device 5 is attached to the upstream side of plate 4 by any suitable method known in the art. Directing device 5 is an elongate, substantially rigid member or members which extend between the side walls. Where flow directing device 5 is a single member, typically it is bent essentially parallel to its edges so that when the member is attached to plate 4, a portion is rigidly disposed with respect to plate 4. Alternatively, a plurality of elongate members can be attached to each other to form the desired angle. Further, the elongate members can comprise a plurality of pieces. The plate/-directing device assembly can also be integrally formed.

Those skilled in the art recognize that confining vessels typically are formed serially in the apparatus. Thus, flights may serve as the trailing flight of a first vessel and as the leading flight of a second, consecutively-formed vessel. Thus, one flight may be simultaneously a leading and a trailing flight. Such a dual-use flight should incorporate the teachings of this invention.

The following example is intended to further illustrate the invention, not to limit its scope. The scope of the invention is limited only by the claims.

EXAMPLE

A fluid bed dryer was provided to process 1.5 mm×19 mm noodles. The stationary bed was a perforated stainless steel plate. The flights were approximately 16" high×23" wide with a 1" angle welded to the bottom of the flight, as illustrated in FIG. 2. The clearance between the bed plate and the bottom of the flight was ¼". The fluidizing medium was hot air, and air velocities above the bed were 800–1100 feet per minute. The horizontal velocity component imparted to the fluidizing air provided a barrier, thereby ensuring that the noodles were retained between the leading and trailing flights so that retention time was well controlled. The horizontal velocity components also provided agitation to prevent agglomeration of the noodles.

Although preferred embodiments of this invention have been discussed herein, those skilled in the art will appreciate that changes and modifications may be made without departing from the spirit of this invention, as defined in and limited only by the scope of the appended claims.

I claim:

1. An indexing fluidized bed apparatus in which at least one vessel for confining fluidized particles is formed comprising a horizontal chamber having first and second side walls, separate means for introducing and removing particles from the chamber, a bottom through which fluidizing medium is introducible and distributible, and a plurality of flights for urging fluidized particles through the apparatus in at least one confining vessel formed by leading and trailing adjacent flights, the first and second side walls, the bottom, and means for retaining the particles, said flights disposed from means for moving the flights through the chamber, said flights extending between the first and second side walls and from the particle retaining means essentially to the bottom;

said trailing flight further comprising means for imparting a horizontal velocity component to the fluidizing medium to prevent particles from escaping from the vessel between the trailing flight and the bottom as the trailing flight is moved through the chamber.

2. The apparatus of claim 1 wherein said particle retaining means comprises orientation of the side walls so that the vertical velocity of the fluidizing medium is insufficient to impart a vertical velocity to the fluidized particles, thus preventing the particles from flowing over the flight.

3. The apparatus of claim 2 wherein the side walls further comprise a lower section adjacent the bottom wherein the side walls are essentially parallel and an upper section wherein the distance between the side walls increases as the distance from the bottom increases, at least a portion of said upper section forming said particle retaining means.

4. The apparatus of claim 1 wherein the means for imparting a horizontal velocity component to the fluidizing medium comprises a first surface upon which the fluidizing medium impinges having first and second spaced-apart edges attached at the first edge to the end of the flight adjacent the bottom, said second edge being disposed further from the bottom than said first edge, thereby disposing said first surface at an angle from the bottom, said first surface imparting the horizontal velocity component to the fluidizing medium.

5. The apparatus of claim 4 further comprising a second surface attached to the second edge of the first surface and to the flight for preventing accumulation of fluidized particles between the first surface and the flight.

6. The apparatus of claim 5 wherein the angle between the first surface and the bottom is adjustable.

7. The apparatus of claim 1 wherein the bottom is divided into a plurality of zones.

8. The apparatus of claim 4 wherein the bottom is divided into a plurality of zones.

9. The apparatus of claim 1 wherein the means for moving the flights comprises at least one horizontally-disposed continuous device selected from the group consisting of belts, chains, and roller chains.

10. An indexing fluidized bed apparatus in which at least one vessel for confining fluidized particles is formed comprising a horizontal chamber having first and second side walls, separate means for introducing and removing particles from the chamber, a bottom through which a fluidizing medium is introducible and distributible, and a plurality of flights for urging fluidized particles through the apparatus in at least one confining vessel formed by leading and trailing adjacent flights, the first and second side walls, the bottom, and means for retaining the particles, said flights being disposed from means for moving the flights through the chamber, each flight extending between the first and second side walls and from the particle retaining means to means for imparting a horizontal velocity component to the fluidizing medium to prevent particles from escaping from the vessel between the trailing flight and the bottom as the trailing flight is moved through the chamber.

11. The apparatus of claim 10 wherein the means for imparting horizontal velocity component to the fluidizing means comprises an open, essentially symmetrical shape attached to the flight with the opening oriented toward and adjacent the bottom of the chamber.

12. The apparatus of claim 11 wherein the shape is an open equilateral triangle.

13. The apparatus of claim 11 wherein the shape is a semicircle.

14. The apparatus of claim 11 wherein the shape is a semiellipse.

15. In a method of fluidizing particles in an indexing fluidized bed apparatus by introducing fluidizing medium into a confining vessel through a bottom through which fluidizing medium is introducible and distributible in an indexing fluidized bed apparatus to fluidize particles which are urged through the fluidizing medium by a flight, the improvement comprising preventing particles from escaping under the flight by imparting a horizontal velocity component to the fluidizing medium near the flight adjacent the bottom after the medium has been introduced into the vessel.

16. The method of claim 15 wherein the horizontal velocity component is imparted by impinging a flow of fluidizing medium upon a non-horizontal surface depending from the flight adjacent the bottom.

* * * * *